US006829456B2

(12) United States Patent
Regimbal et al.

(10) Patent No.: US 6,829,456 B2
(45) Date of Patent: Dec. 7, 2004

(54) PRINTER CALIBRATION SYSTEM AND METHOD

(75) Inventors: Laurent A. Regimbal, Round Rock, TX (US); David E. Smith, Emmett, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/144,088

(22) Filed: May 10, 2002

(65) Prior Publication Data

US 2003/0210926 A1 Nov. 13, 2003

(51) Int. Cl.[7] ..... G03G 15/00
(52) U.S. Cl. ..... 399/167
(58) Field of Search ..... 399/38, 49, 159, 399/163, 167

(56) References Cited

U.S. PATENT DOCUMENTS 4,752,804 A * 6/1988 Ohno ..... 399/167
6,501,930 B2 * 12/2002 Oku ..... 399/167

FOREIGN PATENT DOCUMENTS

JP 10-246995 * 9/1998

* cited by examiner

*Primary Examiner*—Hoang Ngo

(57) ABSTRACT

A printer calibration system and method enables images to be properly aligned over a printable medium in printing systems that use (i) one or more non-ideally shaped image transfer elements and/or (ii) when the one or more image transfer elements behave eccentrically. The systems and methods greatly improve color plane registration and correct for repetitive alignment problems associated with image transfer elements. Non-circularity imperfections associated with image transfer elements are determined. Then the image transfer elements are moved at a non-constant angular velocity to compensate for the circular imperfections.

21 Claims, 5 Drawing Sheets

PRINTER CALIBRATION SYSTEM AND METHOD

TECHNICAL FIELD

The present invention relates generally to monochrome and color printing systems, and more specifically, to image calibration of such printing systems.

BACKGROUND

In printers, especially high quality monochrome and color printers, multiple imaging systems need to unite to form a single image. Typically, these multiple systems are not co-located and attempts are constantly being made to make certain that these systems align. The process of calibrating multiple systems to guarantee alignment is frequently referred to as Color Plane Registration (CPR).

If different colors planes (e.g., cyan (C), magenta (M), and yellow (Y)) are not exactly aligned, then the quality of an image will suffer. There are many very accurate CPR processes, roller aligners, belt procedures, et cetera, to ensure very precise alignment and registration of multiple systems. Yet, despite very precise CPR procedures developed, many manufactures, especially of color laser printers, struggle to manufacture printers that produce very high quality images at reasonable costs.

With constant pressure to reduce manufacturing costs, massively reproduced parts are often manufactured with variances in shape and consistency and affect the ultimate quality of images. Additionally, environmental factors, such as temperature fluctuations, humidity variances, can also cause printing systems to have trouble achieving accurate CPR.

Laser printers, for instance, typically use some type of photoconductor drum and rollers. Instructions from the printer's processor rapidly turn on and off a beam of light from a laser. This beam is deflected across the imaging drum or belt by means of a mirror. Where light hits the negatively charged film on the surface of the drum, the charge is changed to match that of the paper, which is charged positively as it enters the printer. As the drum begins to rotate, a series of gears and rollers draws in a sheet of paper. As the drum turns, it comes into contact with the toner cartridge. The negatively charged toner particles are attracted to the drum areas exposed to the laser. As the sheet of paper moves through, it is pressed against the drum and its electrical charge pulls off the toner. This process is repeated for the other colors, and then fusing rollers bind the toner to the page. If the imaging drums and rollers contain imperfections, then CPR cannot be fully achieved and image quality suffers.

SUMMARY

A calibration system and method for printers is described. The system and method ensures that images are properly aligned in printing systems that use one or more non-ideally shaped image transfer elements and/or when the one or more image transfer elements move eccentrically. In a described method implementation, a non-circular or eccentric imperfection associated with an image transfer element is determined. The image transfer element is then moved at a non-constant angular velocity to compensate for the non-circular imperfection.

BRIEF DESCRIPTION OF THE DRAWINGS

The detailed description is described with reference to the accompanying figures. In the figures, the left-most digit(s) of a reference number identifies the figure in which the reference number first appears.

DETAILED DESCRIPTION

Figure 1:
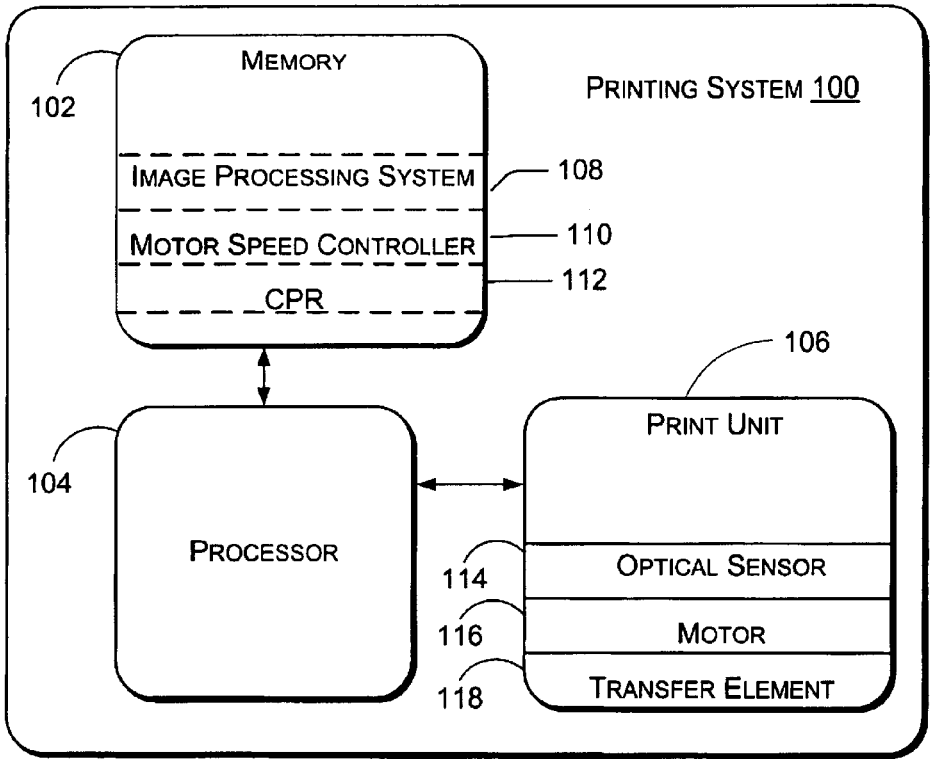
FIG. 1 illustrates various components of an exemplary printing system 100 that can be utilized to implement the techniques described herein.

FIG. 1 illustrates various components of an exemplary printing system 100 that can be utilized to implement the techniques described herein. Most off-the-shelf manufactured printers can be implemented to perform the described implementations herein through the use of hardware, software and/or firmware modifications.

System 100 includes memory 102, a processor 104, and a print unit 106. System 100 may include one or more of any of the aforementioned elements. Memory 102 can also include other components such as RAM, EEPROM and other forms of memory used to store both permanent and erasable information. Memory components 108–112 within memory 102, in the form of flash memory, EEPROM, ROM and/or RAM, store various information, instructions and/or data such as calibration, CPR tests, configuration information, fonts, templates, data being printed, and so forth.

Processor 104 processes various instructions from memory 102 to control the operation of the printing system 100 and to communicate with other electronic, mechanical and computing devices. Processor 104 can be implemented as any type of processing device including, but not limited to: a state-machine, Digital Signal Processor (DSP), a programmable ASIC, or one or more processor chips. Print unit 106 generally includes the mechanical mechanisms arranged to selectively apply an imaging medium such as liquid ink, toner, and the like to a printable medium in accordance with print data corresponding to a print job. The printable medium can include any form of media used for printing such as paper, plastic, fabric, Mylar, transparencies, and the like, and different sizes and types such as 8½×11, A4, roll feed media, etc. The printable medium can also include any printable substrate internal to the printing system 100 such as a transfer or transport belt. Print unit 106 can include an optical sensor 114 for ensuring proper plane registration, a motor(s) 116 for moving transfer elements 118 such as drums and rollers. All of these items ultimately cause an image to be applied to a printable medium in a controlled fashion. In the context of this exemplary description, the "printer device," "printing system," "printer," or the like, means any electronic device having data communications, data storage capabilities, and/or functions to render printed characters and images on a printable medium. A printer may be a copier, plotter, and the like. The term "printer" includes any type of printing device using a transferred imaging medium, such as ejected ink, to create an image on a print media. Examples of such a printer can include, but are not limited to, laser printers, inkjet printers, as well as combinational copier devices. Although specific examples may refer to these printers, such examples are not meant to limit the scope of the claims or the description, but are meant to provide a specific understanding of the described implementations.

Figure 2:
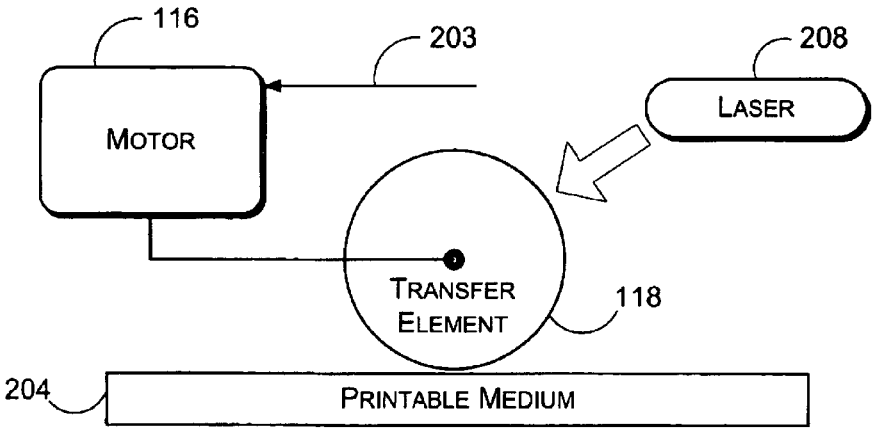
FIG. 2 illustrates select elements from an exemplary print unit used to control the transfer of an image to print media.

FIG. 2 illustrates select elements from print unit 106 used to control the transfer of ink to a print media 204. Transfer element 118 is generally a cylindrical device and can be implemented in a color cartridge or a photoconductor drum or other related devices. Of course, more than one transfer element 204 as part of other color planes can be implemented in a printing system 100. For purposes of representation, motor 202 is shown to directly drive transfer element 118, but as appreciated by those skilled the art, transfer element 118 may be moved indirectly by motor 202 through rollers (not shown) or other means. The speed of motor 202 is controlled by a motor drive signal 203 generated by processor 104 via motor speed controller 110.

Figure 3:
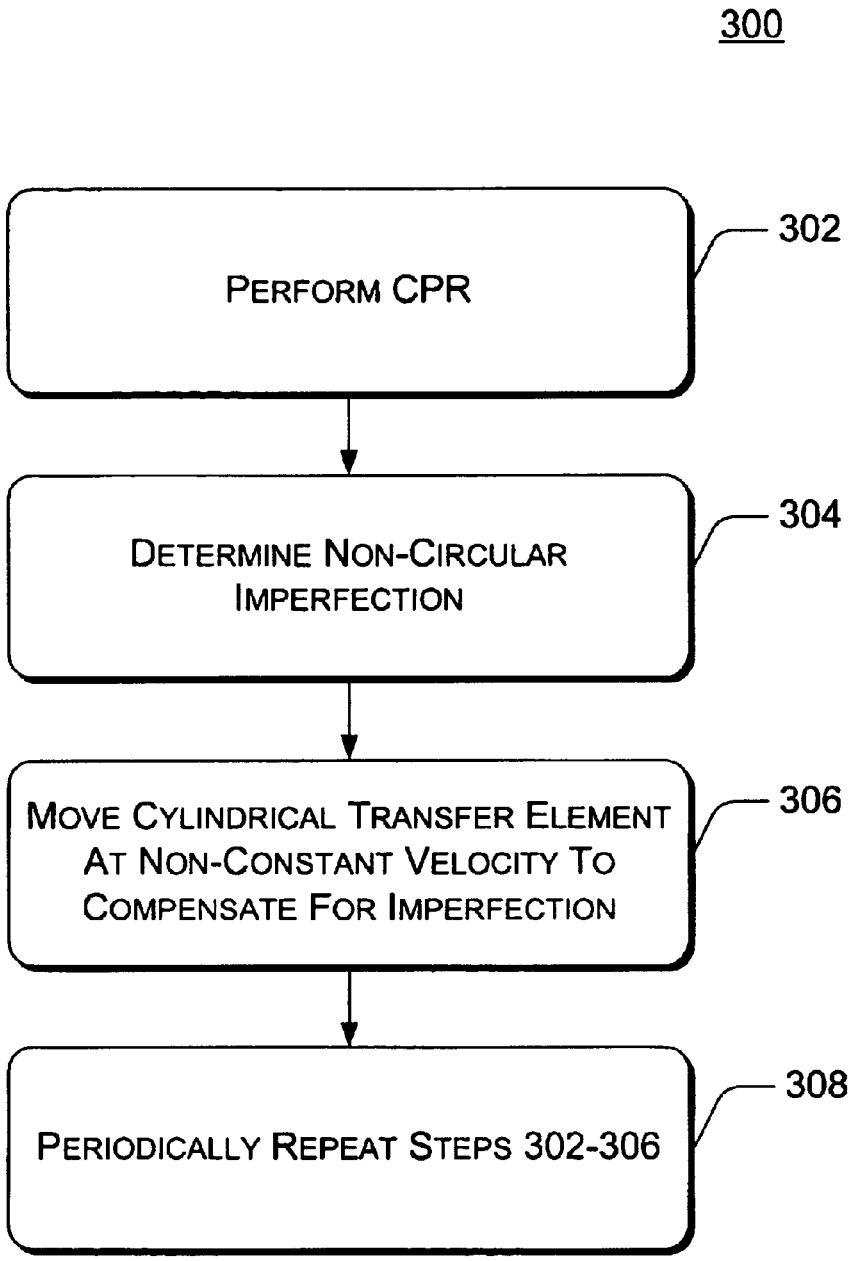
FIG. 3 is a flow chart illustrating a process 300 for correcting for any non-ideal transfer elements.
Figure 6:
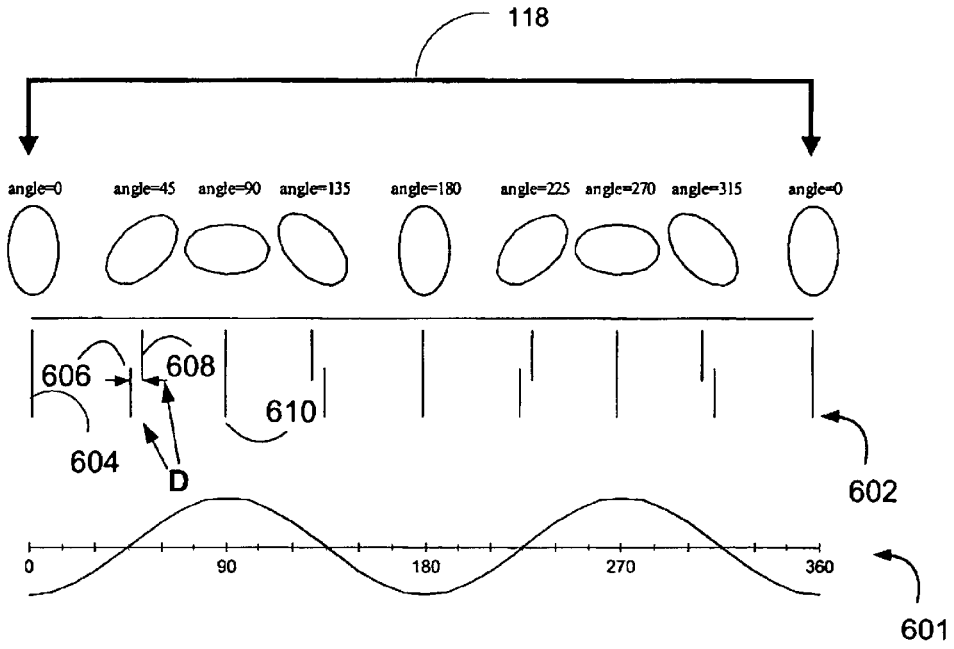
FIG. 6 shows an exaggerated example of a non-ideal transfer element (irregular shaped transfer element) and tick marks associated with the transfer element as it rotates 360 degrees.

A transfer element 118 may not be exactly circular e.g. it may be oval in shape (see for instance FIG. 6). It is also possible, that transfer element 118 may revolve eccentrically due to poor mechanics or other non-ideal conditions (see for instance FIG. 7). In either situation or if both conditions exist at the same time, then poor CPR will result for all or part of the transfer element 118. FIG. 3 is a flow chart illustrating a process 300 for correcting for any such non-circular imperfections or non-ideal eccentricities. For purposes of discussion hereinafter, a "non-circular imperfection" or repetitive imperfections shall refer to non-ideally shaped transfer elements and/or eccentric behavior associated with transfer elements.

Process 300 includes steps 302–308. In step 302, printing system 100 performs CPR. Most color registration systems may be successfully adapted to implement the steps described in process 300 through a few modifications in firmware and/or software in memory 102. Generally, the color registration system used to perform step 302 should be able to perform various positional information and position correction (shifting respective color images) so that different color devices are accurately superimposed or interposed for customer-acceptable full color printed images. The order in which the process is described (including any sub-processes) is not intended to be construed as a limitation. Furthermore, the method can be implemented in hardware, software, firmware, or any suitable combination thereof.

Figure 4:
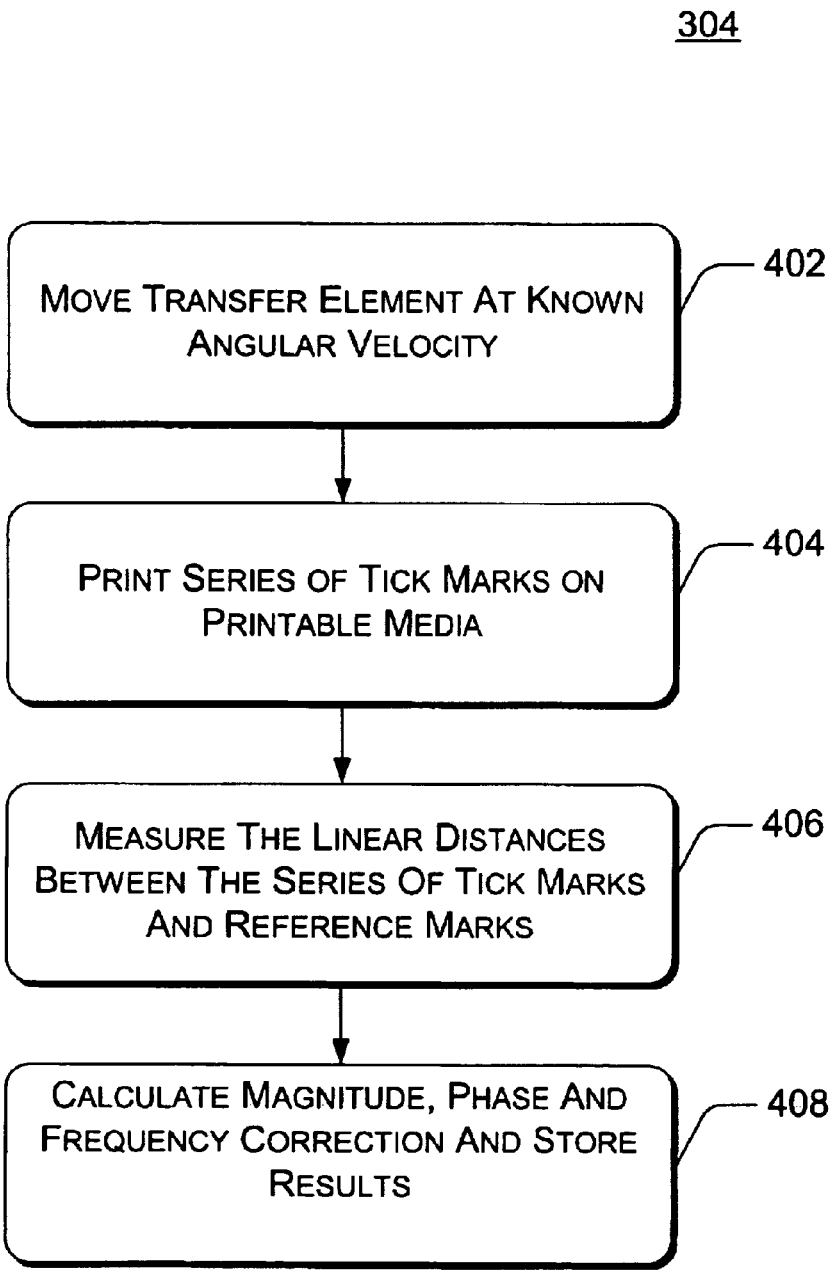
FIGS. 4 and 5 are flow charts illustrating in more detail exemplary implementations for performing operation steps shown in FIG. 3.

In step 304, printing system 100 determines repetitive imperfections associated with transfer element 118. FIG. 4 illustrates an exemplary process for ascertaining repetitive imperfections associated with transfer element 118. Referring to FIG. 4, in step 402 a constant motor drive signal 203 is applied to motor 202 (via motor speed controller 110) so that transfer element revolves at constant angular velocity. It should be noted, that the motor drive signal 203 does not necessary have to be constant when performing step 402. For example, as will be described below, calibration of the printing system 100 can occur after a non-constant velocity is applied to motor drive signal 203. In either case, whether the drive signal is constant or non-constant, all that is needed to perform step 402 is a known value for the drive signal. Thus, in step 402 a predetermined motor drive signal 203 is applied to motor 202 (via motor speed controller 110) so that transfer element 118 revolves at a known (predetermined) angular velocity (whether constant or non-constant).

Figure 7:
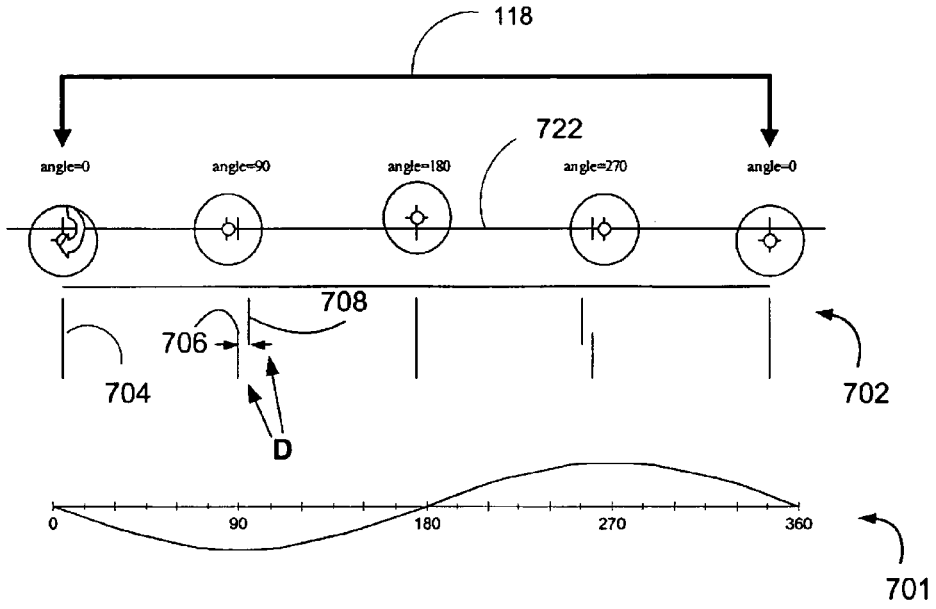
FIG. 7 shows another example of a non-ideal transfer element (that revolves eccentrically) and tick marks associated with the transfer element as it rotates 360 degrees.

Next, in step 404 a series of tick marks are marked onto the printable medium 204, which are shown in FIGS. 6 and 7 as perpendicular lines 602, 702, respectively. The tick marks 602, 702 are placed on the printable media as motor 202 rotates transfer element 118 at constant velocity.

FIG. 6 shows an exaggerated example of a non-ideal transfer element (irregular shaped transfer element) 118 and tick marks 602 associated with the transfer element as it rotates 360 degrees. The ovals at that the top of FIG. 6 represent the transfer element 118 as it moves. That is, the ovals on the upper portion of FIG. 6 represent the various rotational angles of the transfer element 118 as it rotates a full 360 degrees. Below the tick marks 602 is a correctional velocity signal 601 (e.g., correctional drive signal 203) to change to the known drive signal from step 402 to yield a constant linear velocity for transfer element. FIG. 6 is simplified for understanding purposes and the ovals are exaggerated to better illustrate imperfections associated with the transfer element.

FIG. 7 shows another example of a non-ideal transfer element 118 and tick marks associated with the transfer element as it rotates 360 degrees. The circles at that the top of FIG. 7 represent the transfer element 118 as it rotates about an axis 722 eccentrically. That is, the circles on the upper portion of FIG. 7 represent various rotational angles of the transfer element 118 as it rotates a full 360 degrees. Below the tick marks 702 is a correctional velocity signal 701 (e.g., correctional drive signal 203) to change to the drive signal from step 402 to yield a constant linear velocity for transfer element 118. FIG. 7 shows that the transfer element 118 is off-center, which causes it to rotate eccentrically.

In FIGS. 6 and 7, marks 602, 702, respectively are placed on the printable medium 204 at preset intervals of rotation and measured relative to a known reference (optically or otherwise). If the transfer element 118 is circular and concentric the tick marks 602, 702 will be equally spaced in time. For imperfect transfer elements, the change in spacing relative to a known reference can be calculated for various angles and compensation can be made to the rotational drive command. If the point of reference is considered zero at 604, 704 when the first mark is set down, then at the time when mark 608, 708 is set down there is a measurable difference "D" between the reference point 606, 706 and the actual tick mark 608, 708 produced by the transfer element 118.

Referring specifically to FIG. 6, at the 45 degree angle, the tick mark 608 produced by the transfer element is late relative to the reference point 606. The transfer elements is operating at a higher than average linear speed relative to an ideal transfer element. On the other hand, by the time tick mark 610 is placed on the printable medium 204 at the 90 degree angle of rotation, the linear speed of the transfer element 118 has decreased back to an ideal velocity due to the angular imperfection of this exemplary transfer element 118. The average speed of the transfer element at the 90 degree angle of rotation from the first mark is now the same as for a perfect element and therefore the mark is placed in the correct position (i.e. mark 610 lines up perfectly with the reference mark). As shown in FIG. 6, the correctional signal 601 (to be described in more detail) is generated to change the known drive signal for the motor 203 to yield a constant linear velocity for transfer of ink to the printable medium 204 via transfer element 118.

Next, in step 406, the optical system sensor 114 through the image processing system 108 measures the linear distance (e.g., "D" shown in FIGS. 6 and 7) between the series of tick marks during a complete revolution of the transfer element. For an ideal transfer element the distances are all equal and do not require correction.

Next, in step 408, system 100 calculates the magnitude, phase and frequency of correction which can be applied to the motor drive signal 203. The following shows several examples of how to arrive at the corrected motor drive signal 203:

Given a Unit Circle in Polar Coordinates (Ideal Transfer Shape and Center)

$$x^2+y^2=\cos^2\theta+\sin^2\theta=r^2=1^2$$

EXAMPLE 1

For a Circle (Ideal Shape with Eccentricity)

in polar coordinates for a unit circle any point is given by, $x=\cos\theta$, $y=\sin\theta$ for a circular transfer element with eccentricity $x=\cos\theta-\tau$, $y=\sin\theta$ substituting x and y above to solve for r to get r as a function of θ gives the following $$(\cos\theta-\tau)^2+(\sin\theta)^2=r^2=1^2$$

simplifying terms allows the separation of circular and non-circular components $$\cos^2\theta-2\tau\times\cos\theta+\tau^2+\sin^2\theta=1$$

on the left side of the equation, the first and fourth terms represent the ideal circle and would produce the ideal linear speed and must be corrected by subtracting the portion due to the $2^{nd}$ and $3^{rd}$ terms representing the DC and AC corrections respectively $$DC_{correction}=\tau^2 \quad AC_{correction}=-2\tau\times\cos\theta$$

EXAMPLE 2

For an Ellipse (Non-Ideal Shape with Ideal Center)

$$\frac{x^2}{a^2}+\frac{y^2}{b^2}=1$$

to convert to polar coordinates for a unit circle $x=\cos\theta$, $y=\sin\theta$ or upon substitution $$\frac{(\cos\theta)^2}{a^2}+\frac{(\sin\theta)^2}{b^2}=1$$

multiplying the second term of the equation by "one" (in the following form) allows the separation of circular and non-circular components $$\frac{a^2+b^2-b^2}{a^2}=1$$

$$\frac{(\cos\theta)^2}{a^2}+\frac{(\sin\theta)^2}{b^2}\frac{a^2+b^2-b^2}{a^2}=1$$

or $$\frac{(\cos\theta)^2}{a^2}+\left[\frac{(\sin\theta)^2}{b^2}\frac{b^2}{a^2}\right]+\left[\frac{(\sin\theta)^2}{b^2}\frac{a^2-b^2}{a^2}\right]=1$$

which simplifies to $$\frac{(\cos\theta)^2}{a^2}+\left[\frac{(\sin\theta)^2}{b^2}\frac{b^2}{a^2}\right]+\left[\frac{(\sin\theta)^2}{b^2}\frac{a^2-b^2}{a^2}\right]=1$$

for a=1 (in reality a≠1, but this only creates additional DC correction), $$(\cos\theta)^2+(\sin\theta)^2+\left[\frac{(\sin\theta)^2}{b^2}\frac{a^2-b^2}{a^2}\right]=1$$

the first two terms represent the circle expected and the third term is the term that must be nullified using a half-angle trigonometric identity $$\sin^2\theta=\frac{1-\cos2\theta}{2}$$

the term to be nullified becomes $$\frac{a^2-b^2}{a^2b^2}\left(\frac{1-\cos2\theta}{2}\right)$$

where this can be further resolved into DC and AC components to be subtracted from the original velocity profile $$DC_{correction}\propto\frac{a^2-b^2}{a^2b^2}\left(\frac{1}{2}\right) \qquad AC_{correction}\propto\frac{a^2-b^2}{a^2b^2}\left(\frac{\cos2\theta}{2}\right)$$

These examples are shown as an indication that a simple sinusoidal solution exists for many normal non-ideal (non-circular, eccentric) transfer elements that require the superpositioning of an AC signal of proper phase, frequency and amplitude and a correction of the original DC voltage.

Figure 5:
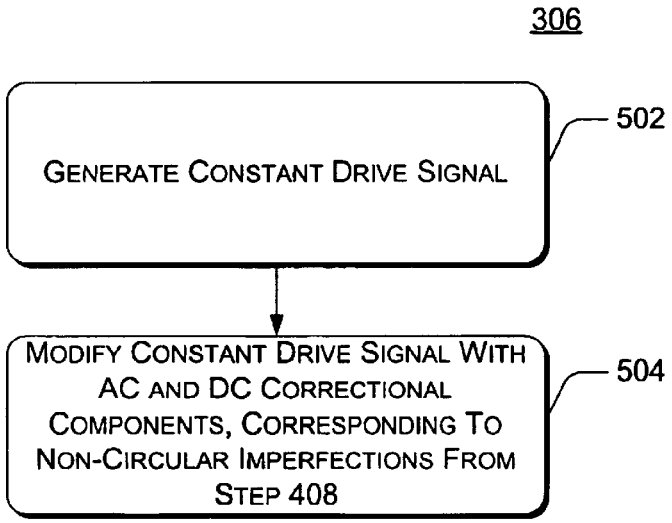

Once the results are stored in memory 102, step 306 can be performed. The transfer element 118 is rotated at a non-constant velocity to compensate for any non-circularity imperfections. In essence, the transfer element 118 once corrected, will behave as if it is moving at constant linear velocity. FIG. 5 shows the steps necessary to perform step 306. Referring to FIG. 5 in steps 502 and 504, the original DC signal used to command the motor to rotate the transfer element 118 would have the DC and AC correction waveforms calculated above subtracted from it or:

$$\text{Motor Drive Signal}=DC_{original}-DC_{correction}-AC_{correction}$$

The measured magnitude, phase and frequency of the corrections is accomplished as described above by printing the series of "tick" marks on the printable medium and directly measuring the differences there. In this way the optimization does not require or pre-suppose concentricity of the transfer element or a rotational or linear encoding device and is instead dependent on the "generated" linear encoding device described.

So, by using the ability of the CPR system to measure the eccentricity of these defects and the timing of them, the printer motors 202 can be controlled to provide a linear drive to minimize the transfer elements 118 circular imperfections.

Referring back to FIG. 3, in step 308, the printing system 100 can periodically repeat steps 302–308. For instance, environmental conditions such as heat and humidity may change as the printing system 100 runs in the morning to warmer conditions in the afternoon. These changes in conditions can exaggerate imperfections at different times. So, it can be beneficial to perform process 300 periodically to maximize accurate registrations, calibration and performance of the printing system.

An implementation of exemplary subject matter using a printer calibration system and method as described in this detailed description section above may be stored on or transmitted across some form of computer-readable media. Computer-readable media can be any available media that can be accessed by a processor.

"Computer storage media" include volatile and non-volatile, removable and non-removable media implemented in any method or technology for storage of information such as computer readable instructions, data structures, program modules, or other data. Computer storage media includes, but is not limited to, RAM, ROM, EEPROM, state machines, DSPs, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by a computer.

"Communication media" typically embodies computer readable instructions, data structures, program modules, or other data in a modulated data signal, such as carrier wave or other transport mechanism. Communication media also includes any information delivery media.

The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above are also included within the scope of computer readable media.

Thus, although some preferred implementations of the various methods and arrangements of the present invention have been illustrated in the accompanying Drawings and described in the foregoing Detailed Description, it will be understood that the invention is not limited to the exemplary aspects disclosed, but is capable of numerous rearrangements, modifications and substitutions without departing from the spirit of the invention as set forth and defined by the following claims.

What is claimed is:

1. In a printing system that uses a cylindrical transfer element to transfer images to a printable medium, a method comprising:

determining a non-circular imperfection associated with the cylindrical transfer element; and moving the cylindrical transfer element at a non-constant angular velocity to compensate for the non-circular imperfection.

2. The method as recited in claim 1, wherein the cylindrical transfer element is a photoconductor drum.

3. The method as recited in claim 1, wherein determining the non-circular imperfection comprises moving the transfer element at a known angular velocity, printing a series of tick marks on the printable medium, measuring linear distances between the series of tick marks and calculating a correction.

4. The method as recited in claim 1, wherein moving the transfer element at a non-constant angular velocity comprises:

generating a constant motor drive signal used to control motor speed for moving the cylindrical transfer element, and modifying the constant motor drive signal, with a magnitude, phase and frequency correction signal corresponding to the non-circular imperfection.

5. The method as recited in claim 1, wherein the non-circular imperfection is determined periodically to account for environmental and operational changes that occur during the operation of the printing system.

6. The method as recited in claim 1, wherein the non-circular imperfection associated with the cylindrical transfer element includes: (i) an ideal cylindrical transfer element revolving eccentrically, (ii) a non-ideally shaped cylindrical transfer element, and/or both (i) and (ii).

7. One or more computer-readable media comprising computer-executable instructions that, when executed, perform a method comprising:

determining a non-circular imperfection associated with the cylindrical transfer element; and moving the cylindrical transfer element at a non-constant angular velocity to compensate for the non-circular imperfection.

8. A printing system, comprising:

a cylindrical transfer element configured to transfer images to one or more printable media;

a motor, configured to move the cylindrical transfer element;

an image processing system, configured to measure a non-circular imperfection associated with the cylindrical transfer element; and a motor speed controller, configured to generate a control signal for the motor to move the cylindrical transfer element at a non-constant angular velocity to compensate for the non-circular imperfection.

9. The system as recited in claim 8, wherein the cylindrical transfer element is a photoconductor drum.

10. The system as recited in claim 8, wherein the image processing system is configured to measure the non-circular imperfection by optically measuring linear distances between a series of tick marks printed on the one or more printable media; wherein the tick marks are printed when the motor speed controller generates a control signal for the motor to move the cylindrical transfer element at a predetermined angular velocity.

11. The system as recited in claim 8, wherein the motor speed controller generates the control signal by generating a constant motor drive and modifying the constant motor drive signal, with a magnitude, phase and frequency correction signal corresponding to the non-circular imperfection.

12. The system as recited in claim 8, wherein the image processing system is further configured to measure a non-circular imperfection associated with the cylindrical transfer element on a periodic basis to account for environmental and operational changes that occur during the operation of the printing system.

13. The system as recited in claim 8, wherein the non-circular imperfection associated with the cylindrical transfer element includes: (i) an ideal cylindrical transfer element revolving eccentrically, (ii) a non-ideally shaped cylindrical transfer element, and/or (i) and (ii).

14. The system as recited in claim 8, wherein the image processing system measures the non-circular imperfection while also performing color plane registration.

15. In a printing system that uses a cylindrical transfer element to transfer images to a printable medium, a method comprising:

rotating the cylindrical transfer element according to a predetermined DC voltage signal;

printing a series of tick marks on the printable medium; measuring linear distances between the series of tick marks; calculating a DC correction signal and an AC correction signal in response to the measured linear distances;

generating a motor drive signal equal to the composite of the original DC signal and the DC and AC corrections signals; and rotating the cylindrical transfer element according to the motor drive signal.

16. The method as recited in claim 15, wherein the cylindrical transfer element is a photoconductor drum.

17. The method as recited in claim 15, wherein the non-circular imperfection associated with the cylindrical transfer element includes: (i) an ideal cylindrical transfer element revolving eccentrically, (ii) a non-ideally shaped cylindrical transfer element, and/or both (i) and (ii).

18. One or more computer-readable media comprising computer-executable instructions that, when executed, perform a method comprising:

rotating the cylindrical transfer element according to a predetermined DC voltage signal;

printing a series of tick marks on the printable medium;

measuring linear distances between the series of tick marks;

calculating a DC correction signal and an AC correction signal in response to the measured linear distances;

generating a motor drive signal equal to the composite of the original DC signal and the DC and AC corrections signals; and rotating the cylindrical transfer element according to the motor drive signal.

19. In a printing system that uses a cylindrical transfer element to transfer images to a printable medium, a method comprising:

determining a non-constant linear velocity along an outer surface of the cylindrical transfer element; and varying an angular velocity of the cylindrical transfer element to yield a constant linear velocity along the outer surface of the cylindrical transfer element.

20. The method as recited in claim 19 wherein the non-constant linear velocity is associated with a non-circular imperfection in the cylindrical transfer element and varying an angular velocity of the cylindrical transfer element to yield a constant linear velocity along the outer surface of the cylindrical transfer element compensates for the non-circular imperfection.

21. A printing system, comprising:

a cylindrical transfer element configured to transfer images to one or more printable media;

a motor configured to rotate the cylindrical transfer element;

an image processing system configured to determine a non-constant linear velocity along an outer surface of the cylindrical transfer element; and a motor speed controller configured to generate a control signal for the motor to vary an angular velocity of the cylindrical transfer element to yield a constant linear velocity along the outer surface of the cylindrical transfer element.

* * * * *